US008807101B2

(12) United States Patent
Choi et al.

(10) Patent No.: US 8,807,101 B2
(45) Date of Patent: Aug. 19, 2014

(54) VARIABLE VALVE LIFT APPARATUS

(75) Inventors: Byong Young Choi, Incheon (KR); Gee Wook Shin, Hwaseong (KR); Sang Won Kim, Seoul (KR); Jin Kook Kong, Suwon-si (KR); Soo Hyung Woo, Yongin-si (KR); Jin Soon Kim, Hwaseong-si (KR); Jei Choon Yang, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 331 days.

(21) Appl. No.: 13/100,894

(22) Filed: May 4, 2011

(65) Prior Publication Data

US 2011/0271922 A1 Nov. 10, 2011

(30) Foreign Application Priority Data

May 6, 2010 (KR) ..... 10-2010-0042402
Dec. 7, 2010 (KR) ..... 10-2010-0124172
Dec. 7, 2010 (KR) ..... 10-2010-0124173

(51) Int. Cl.
*F01L 1/34* (2006.01)

(52) U.S. Cl.
USPC ..... 123/90.16; 123/90.12; 123/90.44

(58) Field of Classification Search
USPC ..... 123/90.16, 90.39, 90.44, 90.6, 90.12, 123/90.48–90.53, 90.59
See application file for complete search history.

(56) References Cited

U.S. PATENT DOCUMENTS 4,844,023 A * 7/1989 Konno et al. ..... 123/90.16
5,782,216 A * 7/1998 Haas et al. ..... 123/90.16
5,950,583 A 9/1999 Kraxner et al.
6,053,133 A * 4/2000 Faria et al. ..... 123/90.16
6,223,706 B1 5/2001 Maas et al.
6,397,804 B1 6/2002 Harada et al.
6,857,406 B2 2/2005 Matsuura et al.
6,948,466 B2 * 9/2005 Haas et al. ..... 123/90.16
7,328,675 B2 * 2/2008 Seitz et al. ..... 123/90.39
7,603,972 B2 * 10/2009 Han et al. ..... 123/90.16
2009/0151682 A1 * 6/2009 Kwak et al. ..... 123/90.48

FOREIGN PATENT DOCUMENTS

CN 101457667 A 6/2009
DE 42 13 147 A1 11/1992
KR 1019990010920 A 2/1999
KR 10-2005-0030732 A 3/2005
KR 10-0774688 B1 11/2007
KR 1020090062259 A 6/2009

OTHER PUBLICATIONS

English Language Machine Translation of KR 1020090062259.*

* cited by examiner

*Primary Examiner* — Kenneth Bomberg
*Assistant Examiner* — Wesley Harris
(74) *Attorney, Agent, or Firm* — Morgan, Lewis & Bockius LLP

(57) ABSTRACT

A variable valve lift apparatus may include an outer tappet body of which a latching portion connecting hole and an outer tappet body guide hole may be formed therewithin, an inner tappet body of which an inner tappet body guide hole may be formed therewithin and slidably disposed within the outer tappet body, a latching portion which may be disposed within the inner tappet body guide hole and selectively coupled to the latching portion connecting hole, a latching portion support pin which guides the latching portion along a longitudinal direction of the inner tappet body guide hole and may be connected to the inner tappet body, a hydraulic pressure chamber, and a plunger which may be slidably disposed in the outer tappet body guide hole and selectively inserts the latching portion into the latching portion connecting hole according to the hydraulic pressure supplied from the hydraulic pressure chamber.

6 Claims, 24 Drawing Sheets

VARIABLE VALVE LIFT APPARATUS

CROSS-REFERENCE TO RELATED APPLICATION

The present application claims priority to Korean Patent Application No. 10-2010-0042402 filed in the Korean Intellectual Property Office on May 6, 2010, and Applications No. 10-2010-0124172 and 10-2010-0124173 filed in the Korean Intellectual Property Office on Dec. 7, 2010, the entire contents of which is incorporated herein for all purposes by this reference.

BACKGROUND OF THE INVENTION

1. Field of the Invention

The present invention relates to a variable valve lift apparatus. More particularly, the present invention relates to variable valve lift apparatus which may change valve lift according to engine operation condition.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches has been undertaken. For example, research has been undertaken for a variable tappet that enables different lifts depending on an engine speed.

The variable valve lift apparatus is required to minimize power loss during opening/closing of valves using torque of a camshaft.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve lift apparatus having advantages of controlling valve lift according to engine operation condition with simple scheme.

In an aspect of the present invention, the variable valve lift apparatus may include an outer tappet body of which a latching portion connecting hole and an outer tappet body guide hole may be formed therewithin, an inner tappet body of which an inner tappet body guide hole may be formed therewithin and slidably disposed within the outer tappet body, a latching portion which may be disposed within the inner tappet body guide hole and selectively coupled to the latching portion connecting hole, a latching portion support pin which guides the latching portion along a longitudinal direction of the inner tappet body guide hole and may be connected to the inner tappet body, a hydraulic pressure chamber which may be formed in the outer tappet body and selectively receives hydraulic pressure, a plunger which may be slidably disposed in the outer tappet body guide hole and selectively inserts the latching portion into the latching portion connecting hole according to the hydraulic pressure supplied from the hydraulic pressure chamber, and a valve connected to the inner tappet body, wherein the latching portion may include a hollow latching pin of which a moving slot may be formed thereto along a longitudinal direction of the hollow latching pin for the latching portion support pin to be inserted thereinto, and a latching pin spring which may be disposed in the hollow latching pin and engaged with the latching portion support pin to elastically support the hollow latching pin toward the plunger.

The latching portion further may include a spring guide portion substantially corresponding to a shape of an inner circumference of the hollow latching pin, being connected to the latching portion support pin and slidably disposed within the hollow latching pin, wherein the spring guide portion may include a spring insert protrusion protruded from a surface of the spring guide portion for the latching pin spring to be coupled thereto.

A link may be formed to an end of the latching pin spring and may be coupled to the latching portion support pin, wherein a contacting surface may be formed to the latching portion support pin and the link may be coupled thereto and wherein a body of the latching pin spring may be placed on the contacting surface.

A contacting surface may be formed to the latching portion support pin for the latching pin spring to closely contact thereto.

A connecting protrusion may be formed to the contacting surface, wherein an end of the latching pin spring may be coupled to the connecting protrusion and a body of the latching pin spring may be placed on the contacting surface.

A connecting hole may be formed to the contacting surface of the latching portion support pin, wherein an end of the latching pin spring may be inserted into the connecting hole and a body of the latching pin spring may be placed on the contacting surface.

In another aspect of the present invention, the variable valve lift apparatus may include an inner swing arm body of which a first contact portion may be formed thereto, of which a guide hole may be formed there inside, of which a valve may be disposed to an end thereof, and of which the other end thereof may be supported by a hydraulic lash adjuster, wherein the inner swing arm selectively pivots around a rotation shaft, an outer swing arm body of which a second contact portion may be formed thereto and further protrudes than the first contact portion, wherein a lift protrusion may be formed to the outer swing arm body and wherein the outer swing arm body selectively rotates around the rotation shaft pivotally coupled to the end of the inner swing arm body, a latching portion which may be disposed within the guide hole and selectively protruded to connect to the lift protrusion, a latching portion support pin which guides the latching portion along a longitudinal direction of the guide hole and may be connected to the inner swing arm body, and a lost motion spring elastically supporting the outer swing arm body, wherein the latching portion may include a hollow latching pin of which a moving slot may be formed thereto along a longitudinal direction of the hollow latching pin for the latching portion support pin to be slidably inserted thereinto, and a latching pin spring which may be disposed in the hollow latching pin and engaged with the latching portion support pin to elastically support the hollow latching pin.

The latching portion further may include a spring guide portion substantially corresponding to a shape of an inner circumference of the hollow latching pin, being connected to the latching portion support pin and being slidably disposed within the hollow latching pin, wherein the spring guide portion may include a spring insert protrusion protruded from a surface of the spring guide portion for the latching pin spring to be connected thereto.

A link may be formed to an end of the latching pin spring and may be coupled to the latching portion support pin, wherein a contacting surface may be formed to the latching portion support pin and the link may be coupled thereto and wherein a body of the latching pin spring may be placed on the contacting surface.

A contacting surface may be formed to the latching portion support pin for the latching pin spring to closely contact thereto.

A connecting protrusion may be formed to the contacting surface, wherein an end of the latching pin spring may be coupled to the connecting protrusion and a body of the latching pin spring may be placed on the contacting surface.

A connecting hole may be formed to the contacting surface of the latching portion support pin, wherein an end of the latching pin spring may be inserted into the connecting hole and a body of the latching pin spring may be placed on the contacting surface.

In further another aspect of the present invention, the variable valve lift apparatus may include an inner rocker arm body of which a first contact portion may be formed thereto, of which a guide hole may be formed there inside, of which a valve may be disposed to an end thereof, and the inner rocker arm body selectively pivoting around a rotation shaft, an outer rocker arm body of which a second contact portion may be formed thereto and further protrudes than the first contact portion, wherein a lift protrusion may be formed to the outer rocker arm body and wherein the outer rocker arm body selectively rotates around the rotation shaft pivotally coupled to the end of the inner rocker arm body, a latching portion which may be disposed within the guide hole and selectively protruded to connect to the lift protrusion, a latching portion support pin which guides the latching portion and may be connected to the inner swing arm body, and a lost motion spring elastically supporting the outer rocker arm body, wherein the latching portion may include a hollow latching pin of which a moving slot may be formed thereto along a longitudinal direction of the hollow latching pin for the latching portion support pin to be slidably inserted thereinto, and a latching pin spring which may be disposed within the hollow latching pin and engaged with the latch portion support pin to elastically support the hollow latching pin.

The latching portion further may include a spring guide portion substantially corresponding to a shape of an inner circumference of the hollow latching pin, being connected to the latching portion support pin and being slidably disposed within the hollow latching pin, wherein the spring guide portion may include a spring insert protrusion protruded from a surface of the spring guide portion for the latching pin spring to be connected thereto.

A link may be formed to an end of the latching pin spring and may be coupled to the latching portion support pin, wherein a contacting surface may be formed to the latching portion support pin and the link may be coupled thereto and wherein a body of the latching pin spring may be placed on the contacting surface.

A contacting surface may be formed to the latching portion support pin for the latching pin spring to closely contact thereto.

A connecting protrusion may be formed to the contacting surface, wherein an end of the latching pin spring may be coupled to the connecting protrusion and a body of the latching pin spring may be placed on the contacting surface.

A connecting hole may be formed to the contacting surface of the latching portion support pin, wherein an end of the latching pin spring may be inserted into the connecting hole and a body of the latching pin spring may be placed on the contacting surface.

According to the exemplary embodiments of present invention, the variable valve lift apparatus may control valve lift according to engine operation condition with simple scheme.

According to the exemplary embodiments, intake valve closing time may be delayed (LIVC; Late Intake Valve Closing) so that pumping loss may be reduced and compression ratio may be increased so that efficiency of an engine may be enhanced.

Movement of axial direction of a latching pin may be limited so that damage of the latching pin may be prevented.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
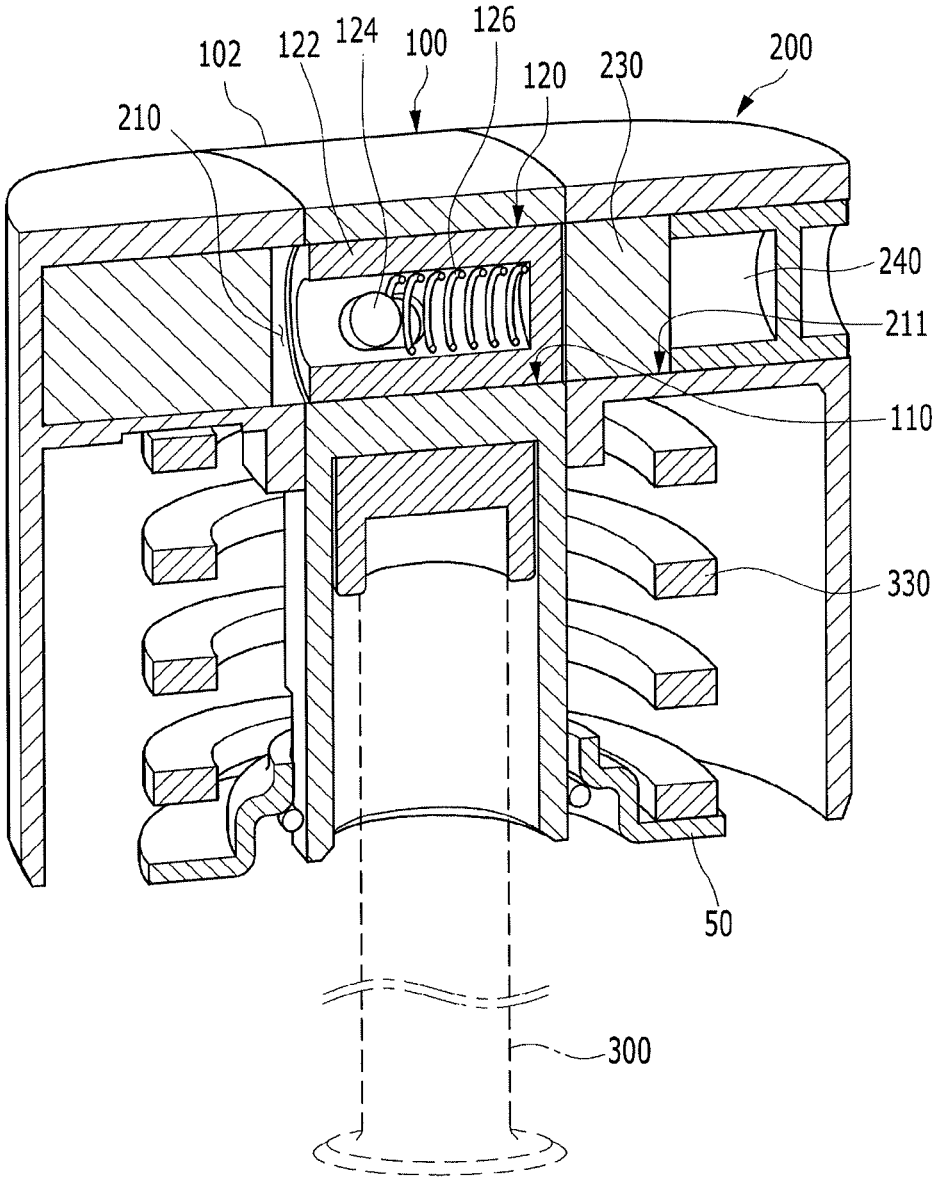
FIG. 1 is a cross-sectional view of a variable valve lift apparatus according to the various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Figure 2:
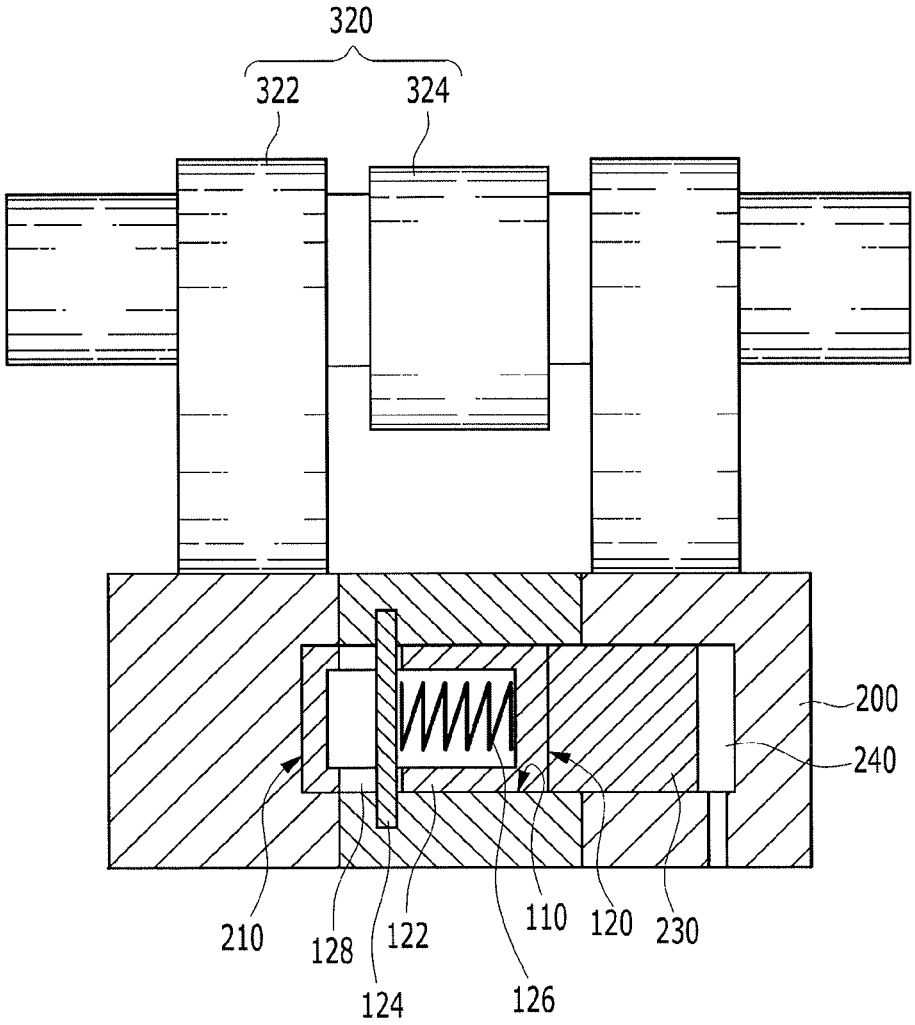
FIG. 2 is a cross-sectional view of a variable valve lift apparatus according to the various exemplary embodiments of the present invention in high lift mode.
Figure 3:
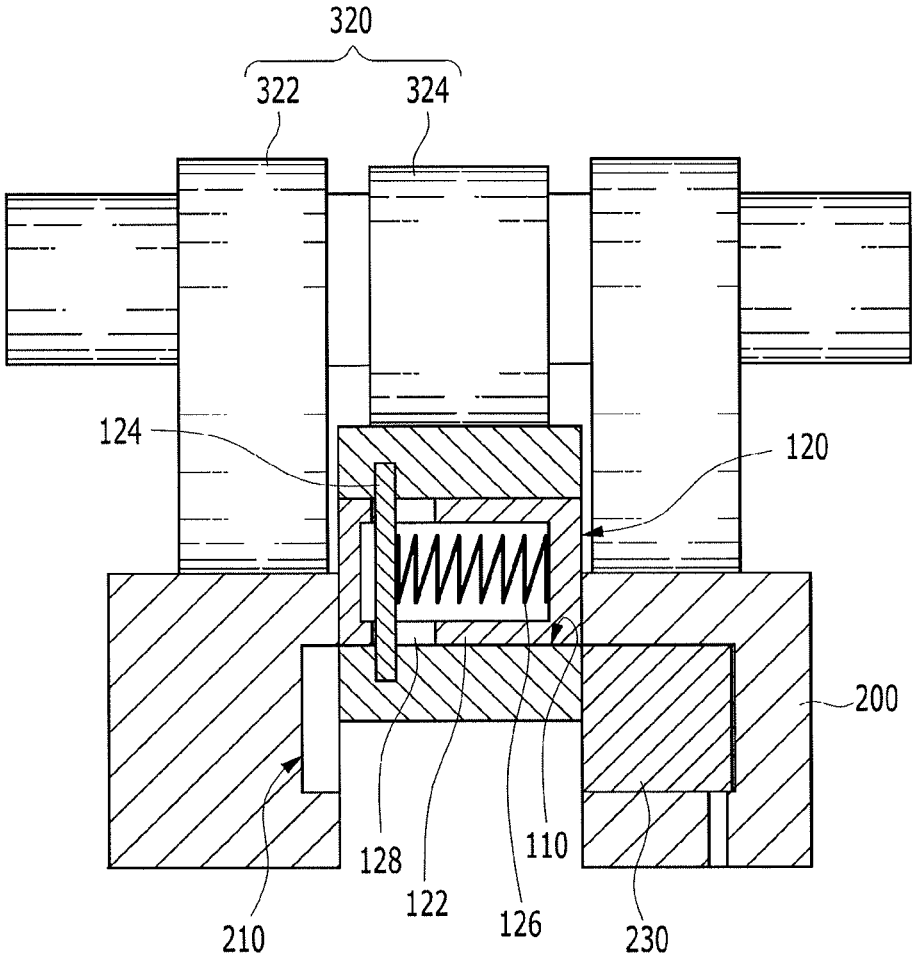
FIG. 3 is a cross-sectional view of a variable valve lift apparatus according to the various exemplary embodiments of the present invention in low lift mode.

FIG. 1 is a cross-sectional view of a variable valve lift apparatus according to the first exemplary embodiment of the present invention, FIG. 2 is a cross-sectional view of a variable valve lift apparatus according to the first exemplary embodiment of the present invention in high lift mode, and FIG. 3 is a cross-sectional view of a variable valve lift apparatus according to the first exemplary embodiment of the present invention in low lift mode.

Figure 4:
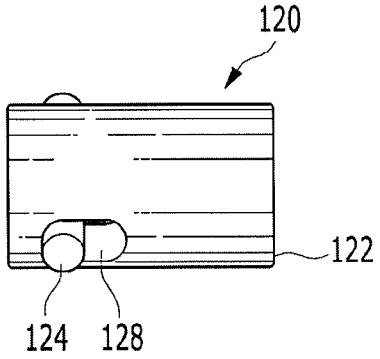
FIG. 4 is a perspective view of a latching portion of a variable valve lift apparatus according to the various exemplary embodiments of the present invention.
Figure 5:
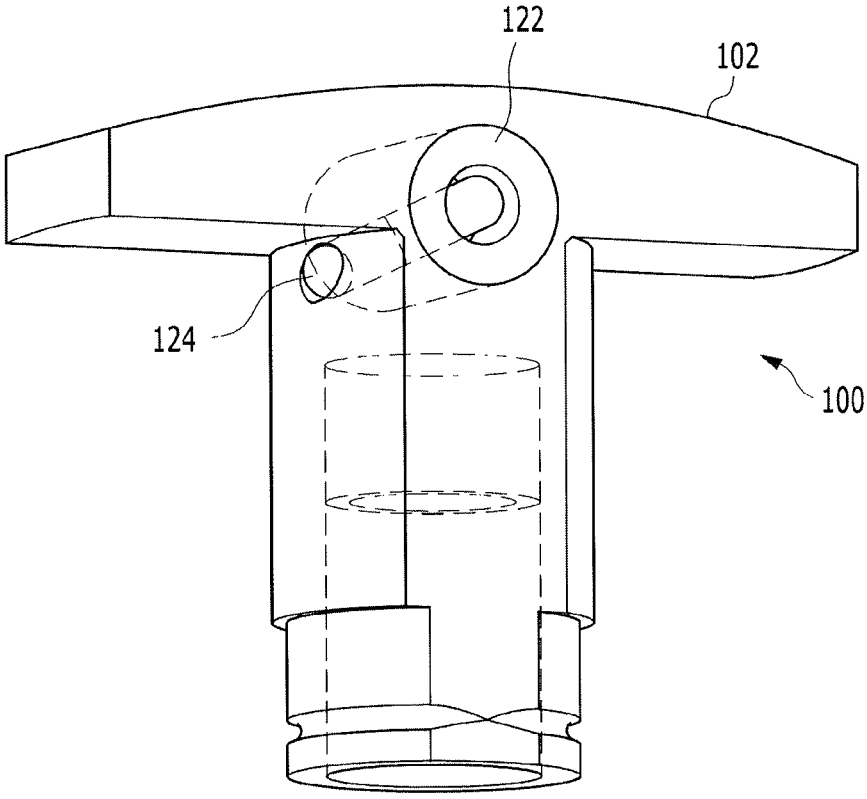
FIG. 5 is a perspective view of an inner tappet body of a variable valve lift apparatus according to the various exemplary embodiments of the present invention.
Figure 6:
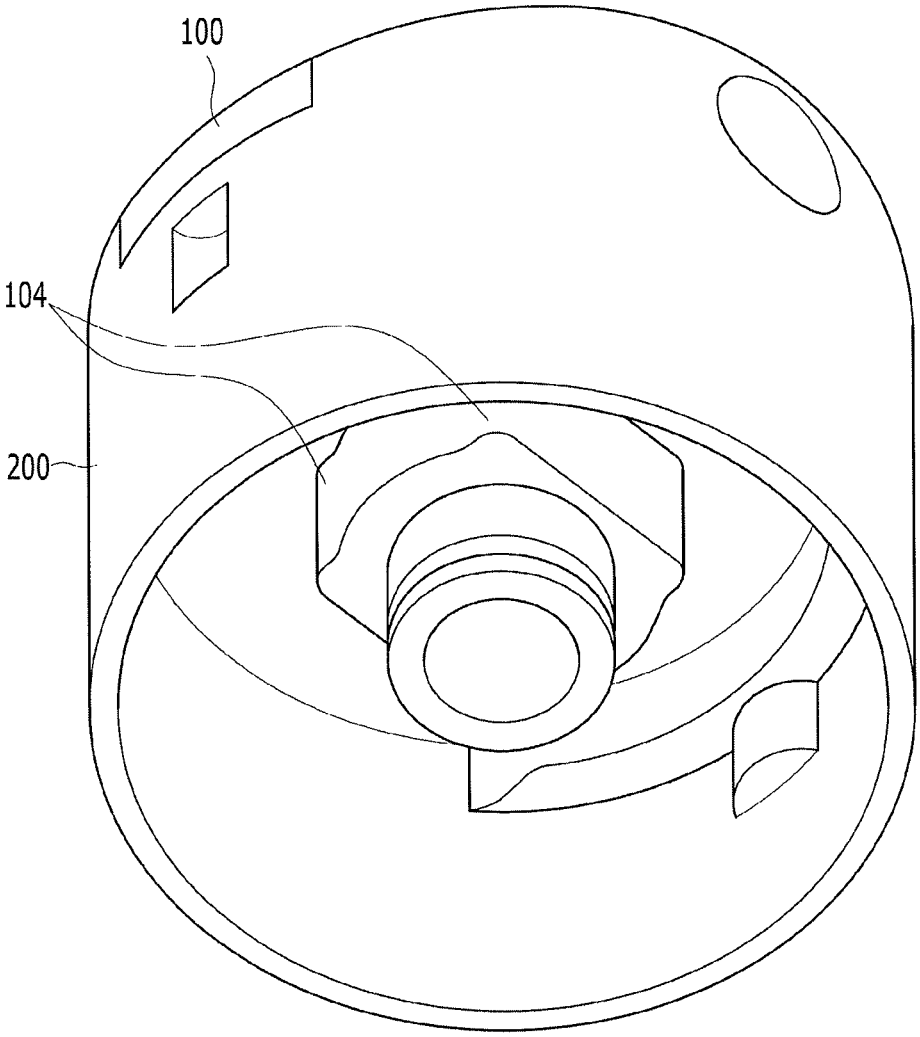
FIG. 6 is a perspective view of an inner tappet body and an outer tappet body of a variable valve lift apparatus according to the various exemplary embodiments of the present invention.

FIG. 4 is a perspective view of a latching portion of a variable valve lift apparatus according to the first exemplary embodiment of the present invention, FIG. 5 is a perspective view of an inner tappet body of a variable valve lift apparatus according to the first exemplary embodiment of the present invention, and FIG. 6 is a perspective view of an inner tappet body and an outer tappet body of a variable valve lift apparatus according to the first exemplary embodiment of the present invention.

Referring to FIG. 1 to FIG. 6, a variable valve lift apparatus according to the first exemplary embodiment of the present invention includes an outer tappet body 200 of which a latching portion connecting hole 210 and an outer tappet body guide hole 211 are formed therewithin, an inner tappet body 100 of which an inner tappet body guide hole 110 is formed therewithin and slidably disposed within the outer tappet body 200, a latching portion 120 which is disposed within the inner tappet body guide hole 110 and selectively inserted into the latching portion connecting hole 210, a latching portion support pin 124 which guides the latching portion 120 and is connected to the inner tappet body 100, and a plunger 230 which is disposed within the outer tappet body guide hole 211 and selectively inserts the latching portion 120 into the latching portion connecting hole 210.

A spring plate 50 is connected to the inner tappet body 100 and a lost motion spring 330 is disposed between the spring plate 50 and the outer tappet body 200 to elastically support the outer tappet body 200.

A valve 300 is connected to the inner tappet body 100 and opened/closed by reciprocal motion of the inner tappet body 100.

The latching portion 120 includes a hollow latching pin 122 of which a moving slot 128 is formed thereto along a longitudinal direction of the hollow latching pin 122 for the latching portion support pin 124 to be inserted thereinto, and a latching pin spring 126 which is disposed within the hollow latching pin 122 to elastically support the hollow latching pin 122.

The hollow latching pin 122 and the plunger 230 may have the same diameters.

A hydraulic pressure chamber 240 is formed to the outer tappet body 200 to supply hydraulic pressure to the plunger 230.

An upper surface 102 of the inner tappet body 100 is formed at length along rotating direction of a cam 320. And thus, intake valve closing time may be delayed (LIVC, Late Intake Valve Closing) so that pumping loss may be reduced and compression ratio may be increased so that efficiency of an engine may be enhanced.

A guide portion 104, as shown in FIG. 6, is formed to the inner tappet body 100 along up and down direction of the inner tappet body 100 to guide the inner tappet body 100.

The shape of the guide portion 104 is not limited to the drawing. On the contrary various modifications and equivalent arrangements allowing reciprocal motion of the inner tappet body 100 and the outer tappet body 200 may be applicable.

Referring to FIG. 1 to FIG. 3, operations of the variable valve lift apparatus according to the first exemplary embodiment of the present invention will be described.

In the general mode, that is in high lift mode, as shown in FIG. 2, hydraulic pressure is supplied to the hydraulic pressure chamber 240 formed within the outer tappet body 200 and then the plunger 230 pushes the hollow latching pin 122. Then the hollow latching pin 122 is inserted into the latching portion connecting hole 210, and the inner tappet body 100 and the outer tappet body 200 integrally reciprocate according to rotation of a high lift cam 322.

That is, the valve 300 is opened according to rotation of the high lift cam 322. In low load of an engine, as shown in FIG. 3, low lift mode is operated.

In the low lift mode, hydraulic pressure within the hydraulic pressure chamber 240 of the outer tappet body 200 is released, and the hollow latching pin 122 is separated from the latching portion connecting hole 210 due to elastic force of the latching pin spring 126 exerting between the hollow latching pin 122 and the latching portion support pin 124. And thus, the inner tappet body 100 and the outer tappet body 200 are operated independently.

That is, the valve 300 is opened by the inner tappet body 100 reciprocating due to rotation of a low lift cam 324. While the outer tappet body 200 reciprocates according to rotation of the high lift cam 322, but the outer tappet body 200 does not have an effect of opening of the valve 300.

The latching portion support pin 124 supports the latching pin spring 126 and also guides and limits axial direction movement of the hollow latching pin 122. And thus, the latching portion support pin 124 and the latching pin spring 126 may prevent damages of the hollow latching pin 122 or the tappet body 100 and 200 due to vibration in lost motion.

Figure 7:
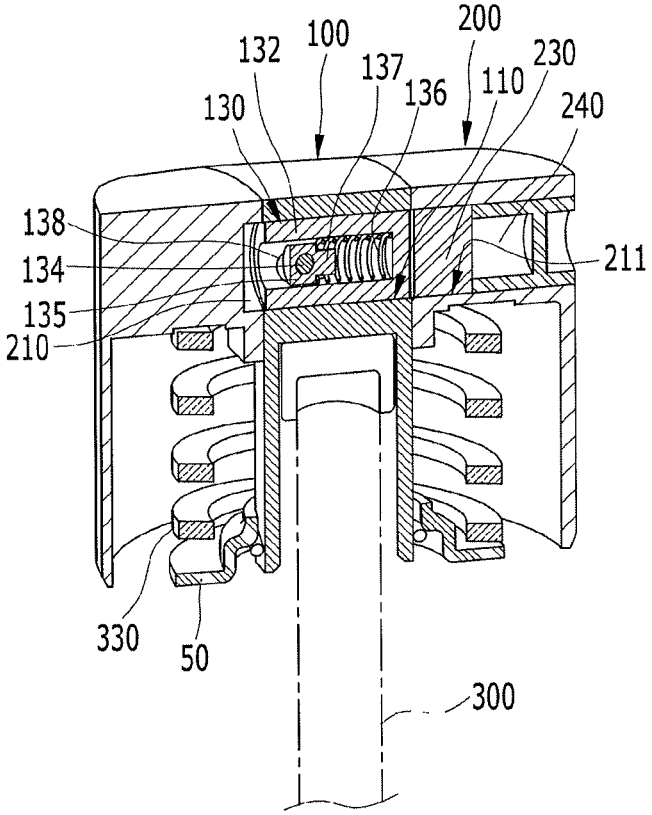
FIG. 7 is a cross-sectional view of a variable valve lift apparatus according to the first exemplary variation of the various exemplary embodiments of the present invention.
Figure 8:
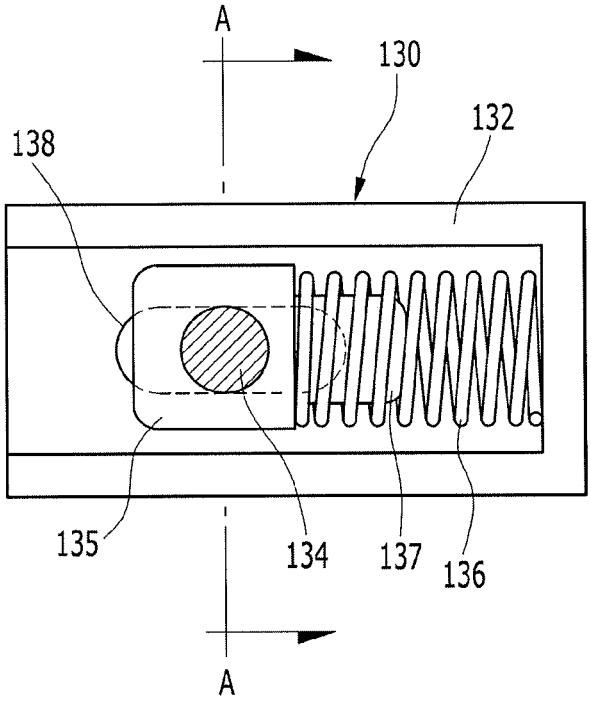
FIG. 8 is a cross-sectional view of a latching portion of a variable valve lift apparatus according to the first exemplary variation of the various exemplary embodiments of the present invention.

FIG. 7 is a cross-sectional view of a variable valve lift apparatus according to the first exemplary variation of the first exemplary embodiment of the present invention and FIG. 8 is a cross-sectional view of a latching portion of a variable valve lift apparatus according to the first exemplary variation of the first exemplary embodiment of the present invention.

Figure 9:
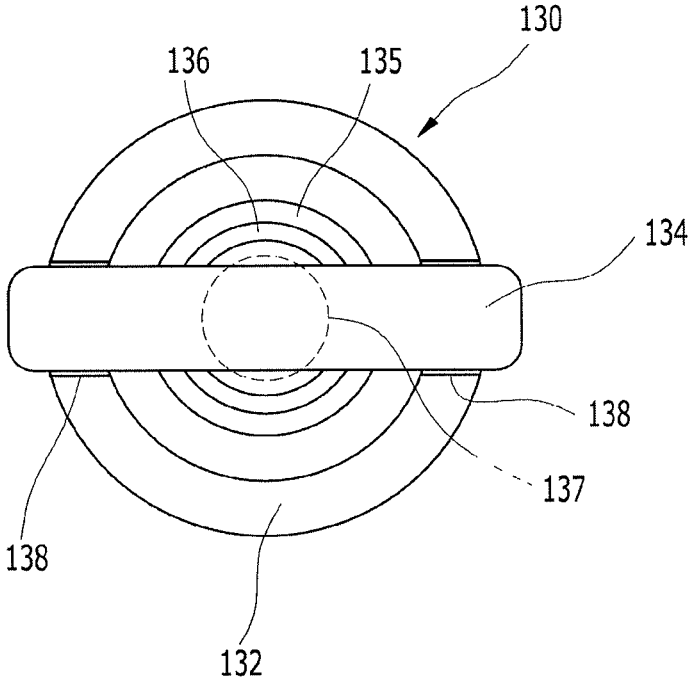
FIG. 9 is a cross-sectional view along line A-A of FIG. 8.
Figure 10:
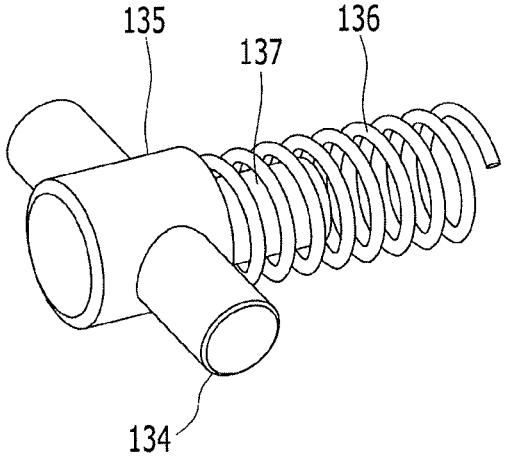
FIG. 10 is a partial perspective view of a latching portion of a variable valve lift apparatus according to the first exemplary variation of the various exemplary embodiments of the present invention.

FIG. 9 is a cross-sectional view along line A-A of FIG. 8 and FIG. 10 is a partial perspective view of a latching portion of a variable valve lift apparatus according to the first exemplary variation of the first exemplary embodiment of the present invention.

A variable valve lift apparatus according to the first exemplary variation of the first exemplary embodiment of the present invention is the same as the variable valve lift apparatus according to the first exemplary embodiment of the present invention except for a latching portion, and the same constituent elements will be designated by the same reference numbers and will be described by the same reference numbers as in other drawings.

Referring to FIG. 7 to FIG. 10, a variable valve lift apparatus according to the first exemplary variation of the first exemplary embodiment of the present invention includes an outer tappet body 200 of which a latching portion connecting hole 210 and an outer tappet body guide hole 211 are formed therewithin, an inner tappet body 100 of which an inner tappet body guide hole 110 is formed therewithin and slidably disposed within the outer tappet body 200, a latching portion 130 which is disposed within the inner tappet body guide hole 110 and selectively inserted into the latching portion connecting hole 210, a latching portion support pin 134 which guides the latching portion 130 and is connected to the inner tappet body 100, and a plunger 230 which is disposed within the outer tappet body guide hole 211 and selectively inserts the latching portion 130 into the latching portion connecting hole 210.

The latching portion 130 includes a hollow latching pin 132 of which a moving slot 138 is formed thereto along a longitudinal direction of the hollow latching pin 132 for the latching portion support pin 134 to be inserted thereinto, and a latching pin spring 136 which is disposed within the hollow latching pin 132 to elastically support the hollow latching pin 132.

The latching portion 130 further includes a spring guide portion 135 connected to the latching portion support pin 134 and slidably disposed within the hollow latching pin 132.

The spring guide portion 135 includes a spring insert protrusion 137 protruded from the spring guide portion 130 for the latching pin spring 136 to be connected thereto.

Figure 11:
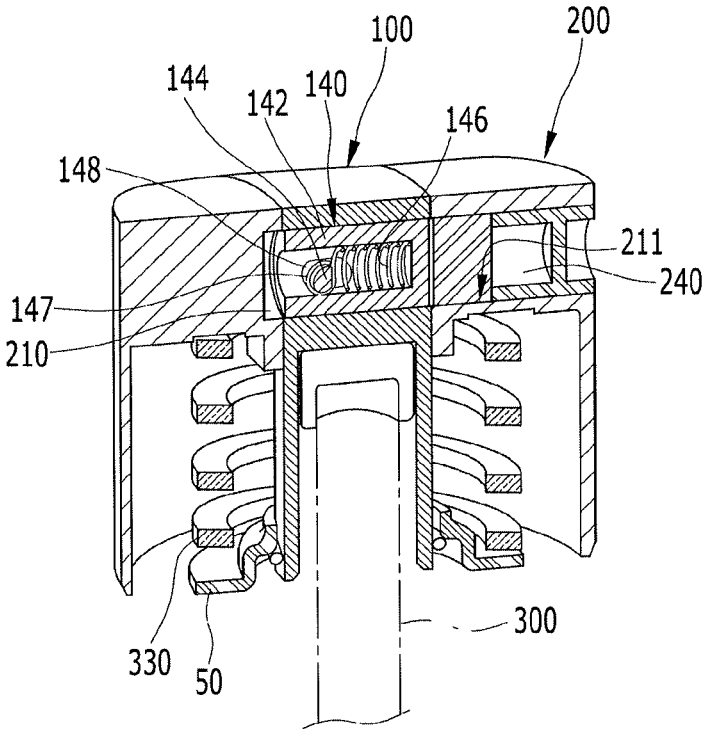
FIG. 11 is a cross-sectional view of a variable valve lift apparatus according to the second exemplary variation of the various exemplary embodiments of the present invention.
Figure 12:
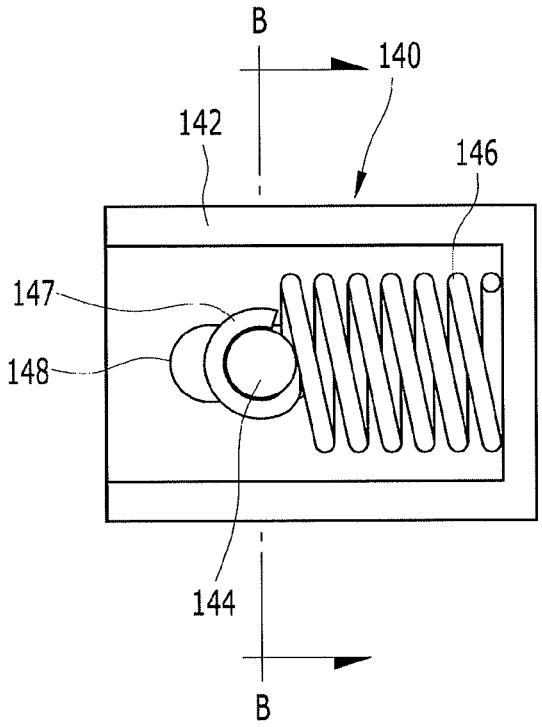
FIG. 12 is a cross-sectional view of a latching portion of a variable valve lift apparatus according to the second exemplary variation of the various exemplary embodiments of the present invention.

FIG. 11 is a cross-sectional view of a variable valve lift apparatus according to the second exemplary variation of the first exemplary embodiment of the present invention, and FIG. 12 is a cross-sectional view of a latching portion of a variable valve lift apparatus according to the second exemplary variation of the first exemplary embodiment of the present invention.

Figure 13:
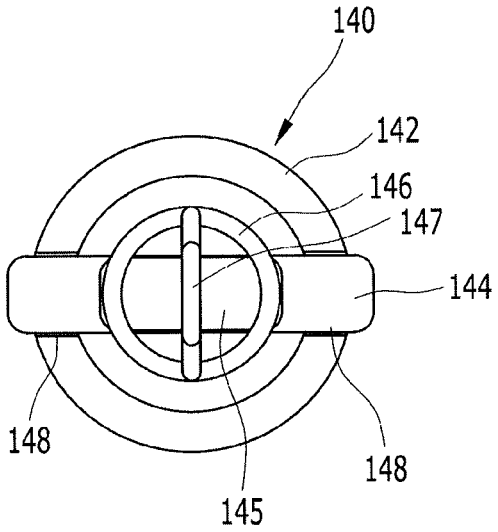
FIG. 13 is a cross-sectional view along line B-B of FIG. 12.
Figure 14:
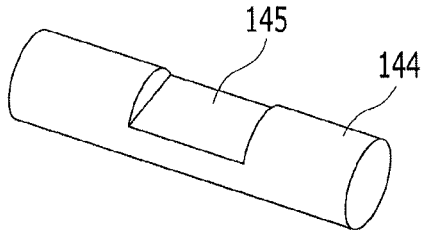
FIG. 14 is a perspective view of a hollow latching pin of a variable valve lift apparatus according to the second exemplary variation of the various exemplary embodiments of the present invention.

FIG. 13 is a cross-sectional view along line B-B of FIG. 12 and FIG. 14 is a perspective view of a hollow latching pin of a variable valve lift apparatus according to the second exemplary variation of the first exemplary embodiment of the present invention.

A variable valve lift apparatus according to the second exemplary variation of the first exemplary embodiment of the present invention is the same as the variable valve lift apparatus according to the first exemplary embodiment of the present invention except for a latching portion, and the same constituent elements will be designated by the same reference numbers and will be described by the same reference numbers as in other drawings.

Referring to FIG. 11 to FIG. 14, a variable valve lift apparatus according to the second exemplary variation of the first exemplary embodiment of the present invention includes an outer tappet body 200 of which a latching portion connecting hole 210 and an outer tappet body guide hole 211 are formed therewithin, an inner tappet body 100 of which an inner tappet body guide hole 110 is formed therewithin and slidably disposed within the outer tappet body 200, a latching portion 140 which is disposed within the inner tappet body guide hole 110 and selectively inserted into the latching portion connecting hole 210, a latching portion support pin 144 which guides the latching portion 140 and is connected to the inner tappet body 100, and a plunger 230 which is disposed within the outer tappet body guide hole 211 and selectively inserts the latching portion 140 into the latching portion connecting hole 210.

The latching portion 140 includes a hollow latching pin 142 of which a moving slot 148 is formed thereto along a longitudinal direction of the hollow latching pin 142 for the latching portion support pin 144 to be inserted thereinto, and a latching pin spring 146 which is disposed within the hollow latching pin 142 to elastically support the hollow latching pin 142.

A link 147, shaped as a ring, is formed to an end of the latching pin spring 146 and is strongly connected to the latching portion support pin 144.

A contacting surface 145 is formed to the latching portion support pin 144 for the latching pin spring 146 to closely contact thereto.

As shown in FIG. 13, in an exemplary embodiment of the present invention, a contacting surface 145 may be formed to the latching portion support pin 144 and the link 147 may be coupled thereto, wherein a body of the latching pin spring 146 may be placed on the contacting surface 145.

Figure 15:
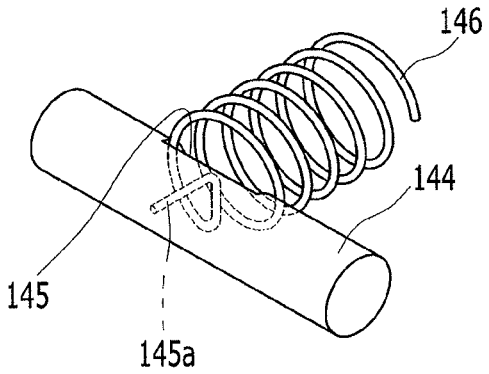
FIG. 15 and FIG. 16 are perspective views of a hollow latching pin and a latching pin spring of according to other exemplary variations of the various exemplary embodiments of the present invention.
Figure 16:
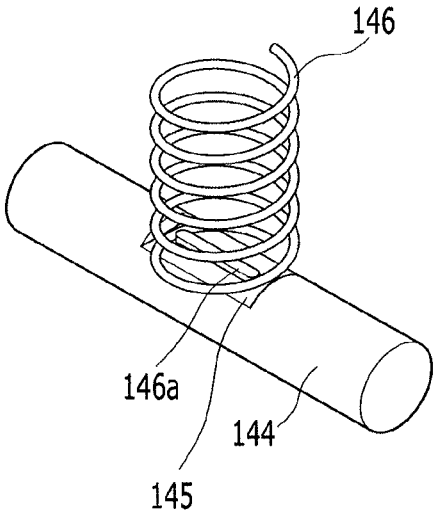

FIG. 15 and FIG. 16 are perspective views of a hollow latching pin and a latching pin spring of according to other exemplary variations of the first exemplary embodiment of the present invention.

Referring to FIG. 15, a connecting hole **145*a* may be formed to the latching portion support pin 144 for an end of the latching pin spring 146** to be inserted thereinto.

In an exemplary embodiment of the present invention, the connecting hole 145*a* may be formed to the contacting surface 145 of the latching portion support pin 144, an end of the latching pin spring 146 may be inserted into the connecting hole 145*a* and a body of the latching pin spring 146 may be placed on the contacting surface 145.

Referring to FIG. 16, a connecting protrusion 146*a* may be formed to the latching portion support pin 144 for an end of the latching pin spring 146 to be inserted thereinto.

In an exemplary embodiment of the present invention, the connecting protrusion 146*a* is formed to the contacting surface 145, an end of the latching pin spring 146 may be coupled to the connecting protrusion 146*a* and a body of the latching pin spring 146 may be placed on the contacting surface 145.

According to the first exemplary embodiment of the present invention and the exemplary variations, since the latching portion support pins 124, 134, and 144 are fixed and the hollow latching pins 122, 132, and 142 are moved being guided by the moving holes 128, 138, and 148 respectively, and thus movement of the hollow latching pins 122, 132, and 142 are stable.

The latching pin spring 136 may be inserted into the spring insert protrusion 137 or be connected the latching portion support pin 144 with the link 147.

And the latching pin spring 146 may be inserted into the connecting hole 145*a* or stably connected to the connecting protrusion 146*a*.

And thus, the latching pin springs 126, 136, and 146 may be stably compressed or extended so as to reduce abrasion and increase durability.

The spring guide portion 135 may be act as a stopper when the latching pin spring 136 is excessively compressed to impact.

Since both ends of the latching pin springs 126, 136, and 146 are supported in parallel and thus the latching pin springs 126, 136, and 146 are structurally stable.

Figure 17:
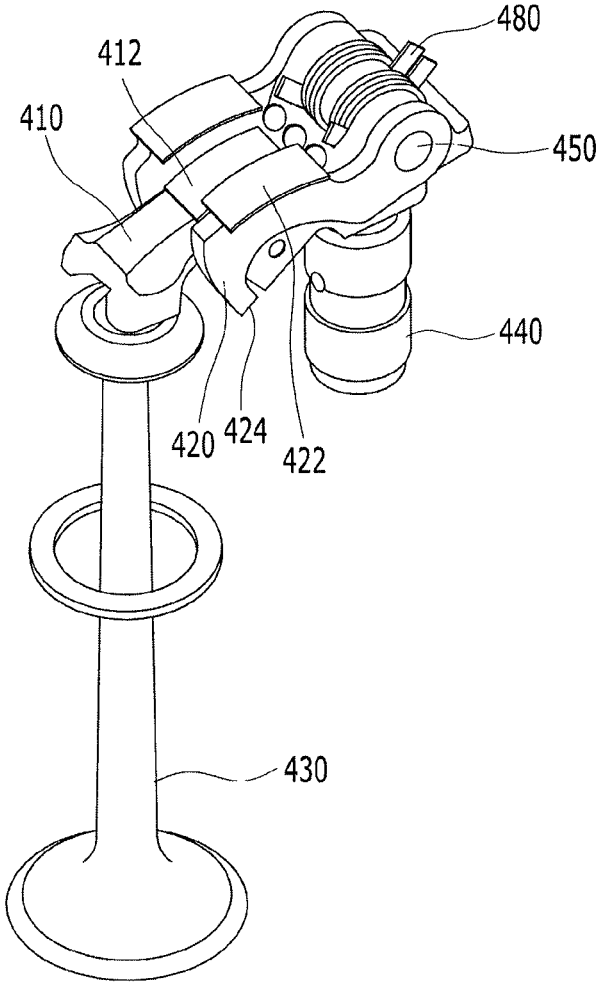
FIG. 17 is a perspective view of a variable valve lift apparatus according to the various exemplary embodiments of the present invention.
Figure 18:
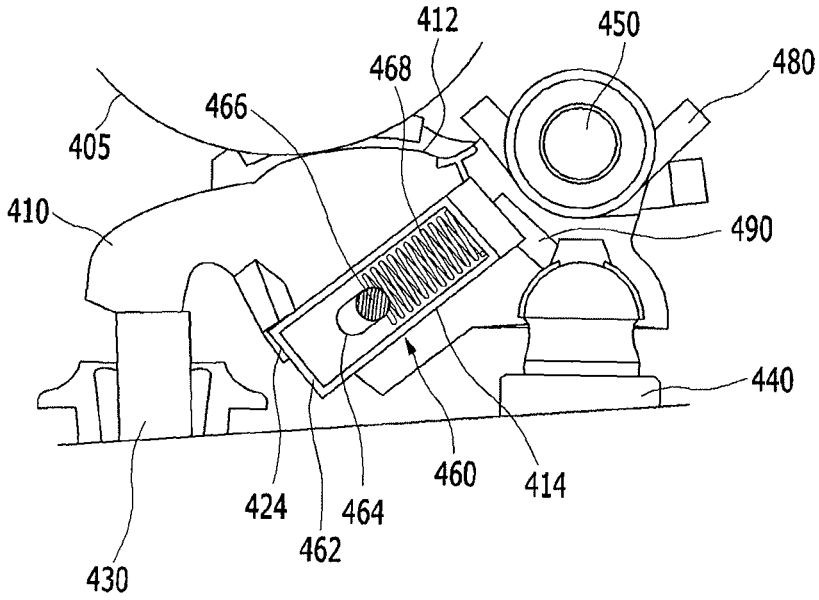
FIG. 18 is a cross-sectional view of a variable valve lift apparatus according to the various exemplary embodiments of the present invention.

FIG. 17 is a perspective view of a variable valve lift apparatus according to the second exemplary embodiment of the present invention, and FIG. 18 is a cross-sectional view of a variable valve lift apparatus according to the second exemplary embodiment of the present invention.

Referring to FIG. 17 and FIG. 18, a variable valve lift apparatus according to the second exemplary embodiment of the present invention includes an inner swing arm body 410 of which a first contact portion 412 is formed thereto, of which a guide hole 414 is formed there inside, of which a valve 430 is disposed to an end thereof, of which the other end is supported by a hydraulic lash adjuster 440, and the inner swing arm body 410 pivoting around a rotation shaft 450, an outer swing arm body 420 of which a second contact portion 422, further protruded than the first contact portion 412, is formed thereto, of which a lift protrusion 424 is formed thereto, and the outer swing arm body 420 rotating around the rotation shaft 450, a latching portion 460 which is disposed within the guide hole 414 and selectively protruded to connect to the lift protrusion 424, a latching portion support pin 466 which guides the latching portion 460 and is connected to the inner swing arm body 410, and a lost motion spring 480 elastically supporting the outer swing arm body 420.

The latching portion 460 includes a hollow latching pin 462 of which a moving slot 464 is formed thereto along a longitudinal direction of the hollow latching pin 462 for the latching portion support pin 466 to be inserted thereinto, and a latching pin spring 468 which is disposed within the hollow latching pin 462 to elastically support the hollow latching pin 462.

The variable valve lift apparatus further includes a hydraulic line 490 formed to supply hydraulic pressure from the hydraulic lash adjuster 440 to the hollow latching pin 462.

Hereinafter, operations of the variable valve lift apparatus according to the second exemplary embodiment of the present invention will be described.

A cam 405 contacts and pushes the first contact portion 412 and the second contact portion 422 and the valve 430 is opened.

Shapes or operations of the cam 405 are obvious to a person skilled in the art related to the present invention, and thus detailed explanation will be omitted.

When hydraulic pressure is supplied to the hydraulic line 490, the hollow latching pin 462 is protruded to connect to the lift protrusion 424.

And thus, the valve 430 is opened according to movement of the outer swing arm body 420.

When hydraulic pressure within the hydraulic line 490 is released, the hollow latching pin 462 moves into inside of the guide hole 414 due to elastic force of the latching pin spring 468 and thus the lift protrusion 424 and the hollow latching pin 462 are separated.

The outer swing arm body 420 moves up and down without valve opening (lost motion), and the valve 430 is opened according to movements of the inner swing arm body 410.

Figure 19:
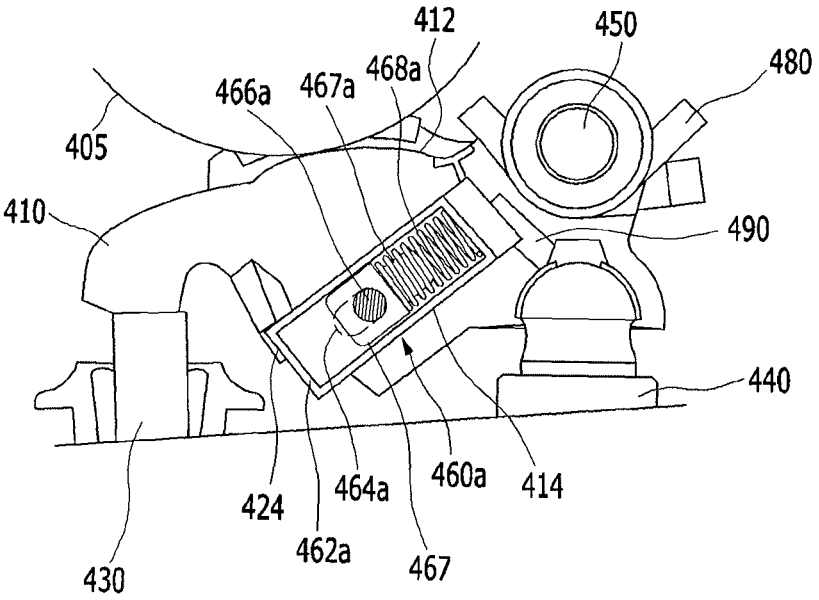
FIG. 19 is a cross-sectional view of a variable valve lift apparatus according to the first exemplary variation of the various exemplary embodiments of the present invention.

FIG. 19 is a cross-sectional view of a variable valve lift apparatus according to the first exemplary variation of the second exemplary embodiment of the present invention.

A variable valve lift apparatus according to the first exemplary variation of the second exemplary embodiment of the present invention is the same as the variable valve lift apparatus according to the second exemplary embodiment of the present invention except for a latching portion, and the same constituent elements will be designated by the same reference numbers and will be described by the same reference numbers as in other drawings.

Referring to FIG. 17 and FIG. 19, a variable valve lift apparatus according to the first exemplary variation of the second exemplary embodiment of the present invention includes an inner swing arm body 410 of which a first contact portion 412 is formed thereto, of which a guide hole 414 is formed there inside, of which a valve 430 is disposed to an end thereof, of which the other end is supported by a hydraulic lash adjuster 440, and the inner swing arm body 410 pivoting around a rotation shaft 450, an outer swing arm body 420 of which a second contact portion 422, further protruded than the first contact portion 412, is formed thereto, of which a lift protrusion 424 is formed thereto, and the outer swing arm body 420 rotating around the rotation shaft 450, a latching portion 460*a* which is disposed within the guide hole 414 and selectively protruded to connect to the lift protrusion 424, a latching portion support pin 466*a* which guides the latching portion 460*a* and is connected to the inner swing arm body 410, and a lost motion spring 480 elastically supporting the outer swing arm body 420.

The latching portion 460*a* includes a hollow latching pin 462*a* of which a moving slot 464*a* is formed thereto along a longitudinal direction of the hollow latching pin 462*a* for the latching portion support pin 466*a* to be inserted thereinto, and a latching pin spring 468*a* which is disposed within the hollow latching pin 462*a* to elastically support the hollow latching pin 462*a*.

The latching portion 460*a* further includes a spring guide portion 467 connected to the latching portion support pin 466*a* and slidably disposed within the hollow latching pin 462*a*.

The spring guide portion 467 includes a spring insert protrusion 467*a* protruded from the spring guide portion 467 for the latching pin spring 466*a* to be connected thereto.

Figure 20:
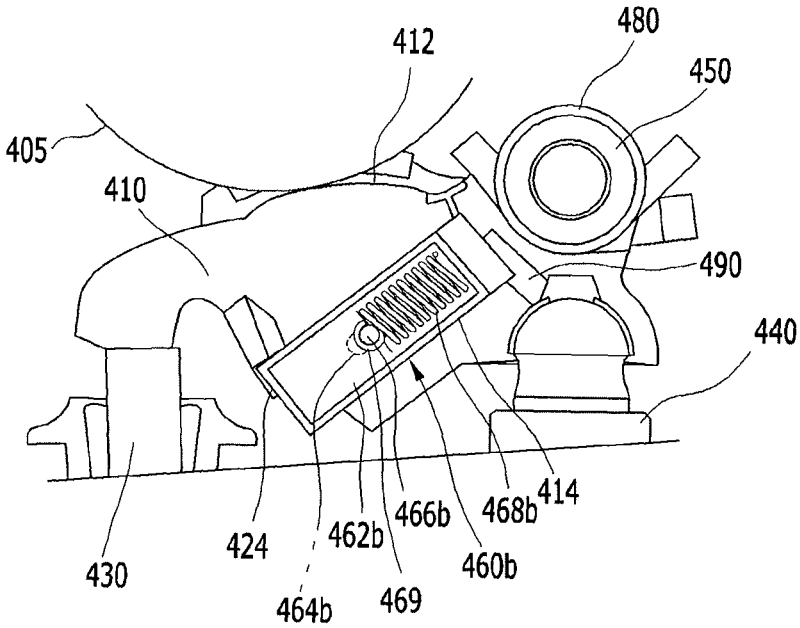
FIG. 20 is a cross-sectional view of a variable valve lift apparatus according to the second exemplary variation of the various exemplary embodiments of the present invention.

FIG. 20 is a cross-sectional view of a variable valve lift apparatus according to the second exemplary variation of the second exemplary embodiment of the present invention.

A variable valve lift apparatus according to the second exemplary variation of the second exemplary embodiment of the present invention is the same as the variable valve lift apparatus according to the second exemplary embodiment of the present invention except for a latching portion, and the same constituent elements will be designated by the same reference numbers and will be described by the same reference numbers as in other drawings.

Referring to FIG. 17 and FIG. 20, a variable valve lift apparatus according to the second exemplary variation of the second exemplary embodiment of the present invention includes an inner swing arm body 410 of which a first contact portion 412 is formed thereto, of which a guide hole 414 is formed there inside, of which a valve 430 is disposed to an end thereof, of which the other end is supported by a hydraulic lash adjuster 440, and the inner swing arm body 410 pivoting around a rotation shaft 450, an outer swing arm body 420 of which a second contact portion 422, further protruded than the first contact portion 412, is formed thereto, of which a lift protrusion 424 is formed thereto, and the outer swing arm body 420 rotating around the rotation shaft 450, a latching portion 460*b* which is disposed within the guide hole 414 and selectively protruded to connect to the lift protrusion 424, a latching portion support pin 466*b* which guides the latching portion 460*b* and is connected to the inner swing arm body 410, and a lost motion spring 480 elastically supporting the outer swing arm body 420.

The latching portion 460*b* includes a hollow latching pin 462*b* of which a moving slot 464*b* is formed thereto along a longitudinal direction of the hollow latching pin 462*b* for the latching portion support pin 466*b* to be inserted thereinto, and a latching pin spring 468*b* which is disposed within the hollow latching pin 462*a* to elastically support the hollow latching pin 462*b*.

A link 469, shaped as a ring, is formed to an end of the latching pin spring 468*b* and is strongly connected to the latching portion support pin 466*b*.

A contacting surface, as shown in FIG. 14, may be formed to the latching portion support pin 466*b* for the latching pin spring 468*b* to closely contact thereto.

And also, a connecting hole may be formed to the latching portion support pin 466*b* for and end of the latching pin spring 468*b* to be inserted thereinto, or a connecting protrusion may be formed to the latching portion support pin 466*b* for and end of the latching pin spring 468*b* to be connected thereto, as shown in FIG. 15 and FIG. 16.

According to the second exemplary embodiment of the present invention and the exemplary variations, since the latching portion support pins 466, 466*a*, 466*b* are fixed and the hollow latching pins 462, 462*a*, 462*b* are moved being guided by the moving holes 464, 464*a*, 464*b* respectively, and thus movement of the hollow latching pins 462, 462*a*, 462*b* are stable.

And thus, the latching pin springs 468, 468*a*, 468*b* may be stably compressed or extended so as to reduce abrasion and increase durability.

The spring guide portion 467 may be act as a stopper when the latching pin spring 468*a* is excessively compressed to impact.

Since both ends of the latching pin springs 468, 468*a*, 468*b* are supported in parallel and thus the latching pin springs 468, 468*a*, 468*b* are structurally stable.

Figure 21:
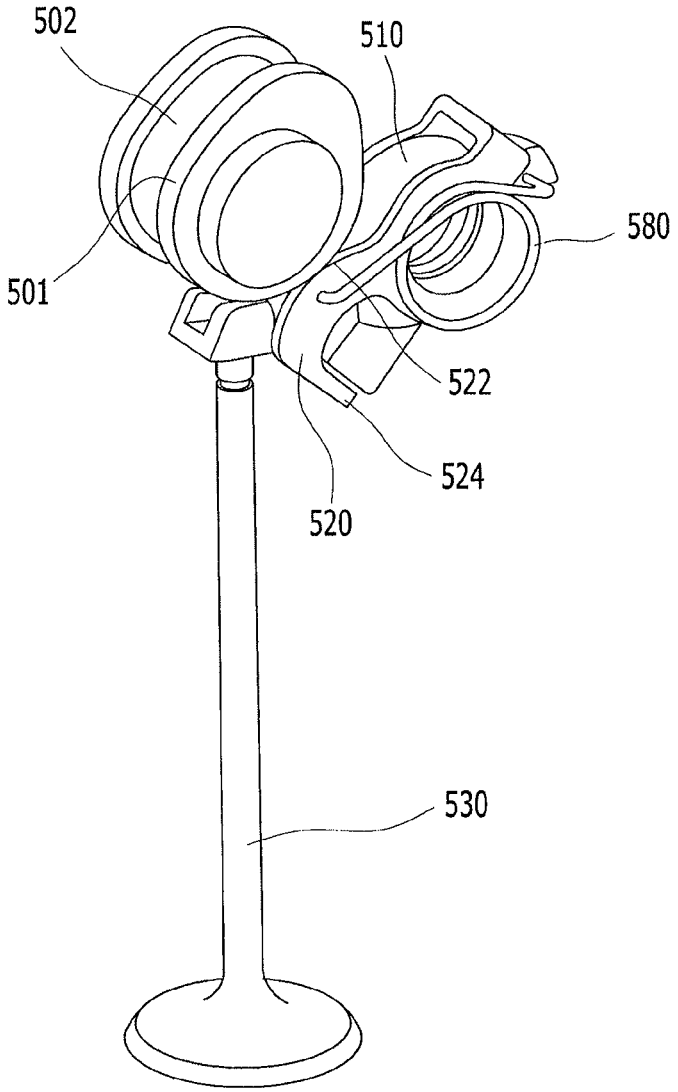
FIG. 21 is a perspective view of a variable valve lift apparatus according to the various exemplary embodiments of the present invention.
Figure 22:
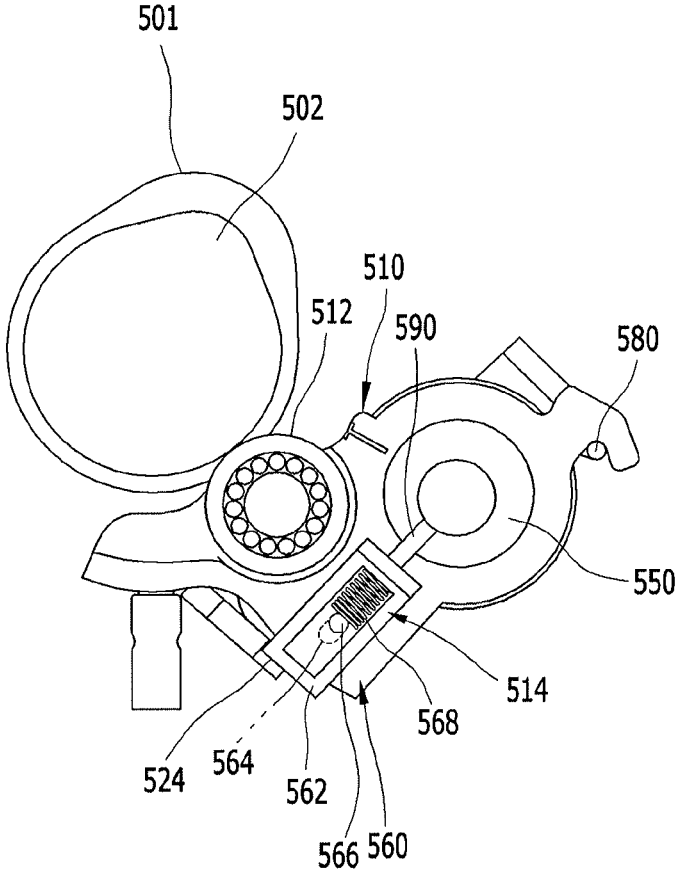
FIG. 22 is a cross-sectional view of a variable valve lift apparatus according to the various exemplary embodiments of the present invention.

FIG. 21 is a perspective view of a variable valve lift apparatus according to the third exemplary embodiment of the present invention, and FIG. 22 is a cross-sectional view of a variable valve lift apparatus according to the third exemplary embodiment of the present invention.

Referring to FIG. 21 and FIG. 22, a variable valve lift apparatus according to the third exemplary embodiment of the present invention includes an inner rocker arm body 510 of which a first contact portion 512 is formed thereto, of which a guide hole 514 is formed there inside, of which a valve 530 is disposed to an end thereof, and the inner rocker arm body 510 pivoting around a rotation shaft 550, an outer rocker arm body 520 of which a second contact portion 522, further protruded than the first contact portion 512, is formed thereto, of which a lift protrusion 524 is formed thereto, and the outer rocker arm body 520 rotating around the rotation shaft 550, a latching portion 560 which is disposed within the guide hole 514 and selectively protruded to connect to the lift protrusion 524, a latching portion support pin 566 which guides the latching portion 560 and is connected to the inner rocker arm body 510, and a lost motion spring 580 elastically supporting the outer rocker arm body 520.

The latching portion 560 includes a hollow latching pin 562 of which a moving slot 564 is formed thereto along a longitudinal direction of the hollow latching pin 562 for the latching portion support pin 566 to be inserted thereinto, and a latching pin spring 568 which is disposed within the hollow latching pin 562 to elastically support the hollow latching pin 562.

The variable valve lift apparatus further includes a hydraulic line 590 formed to supply hydraulic pressure from the rocker arm shaft 550 to the hollow latching pin 562.

Hereinafter, operations of the variable valve lift apparatus according to the third exemplary embodiment of the present invention will be described.

Referring to FIG. 21 and FIG. 22, a high lift cam 501 and a low lift cam 502 contacts the first contact portion 512 and the second contact portion 522 respectively and the valve 530 is opened.

When hydraulic pressure is supplied to the hydraulic line 590, the hollow latching pin 562 is protruded to connect to the lift protrusion 524.

And thus, the valve 530 is opened according to movement of the outer rocker arm body 520.

When hydraulic pressure within the hydraulic line 590 is released, the hollow latching pin 562 moves into inside of the guide hole 514 due to elastic force of the latching pin spring 568 and thus the lift protrusion 524 and the hollow latching pin 562 are separated.

The outer rocker arm body 520 moves up and down without valve opening (lost motion), and the valve 530 is opened according to movements of the inner swing arm body 510.

Figure 23:
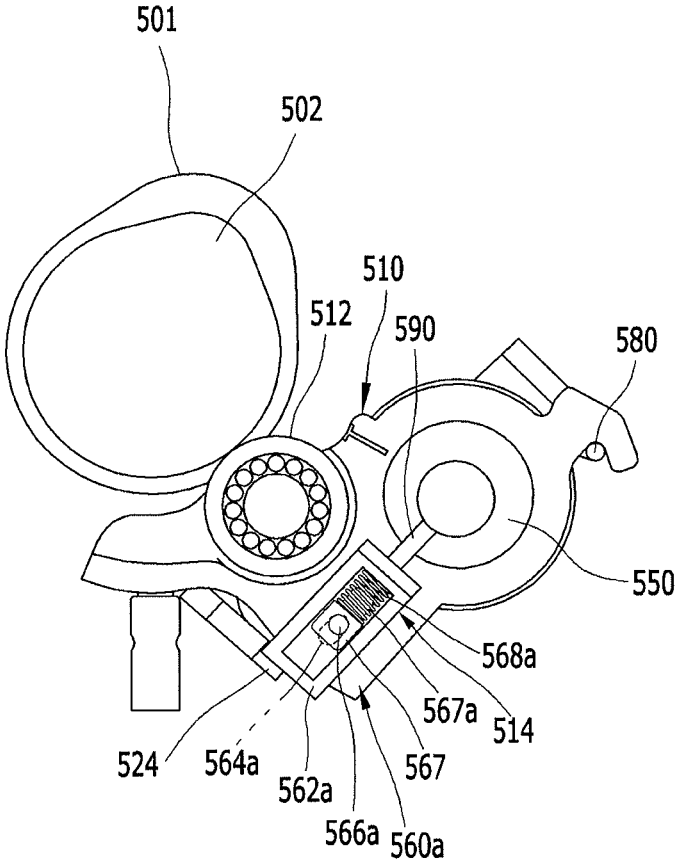
FIG. 23 is a cross-sectional view of a variable valve lift apparatus according to the first exemplary variation of the various exemplary embodiments of the present invention.

FIG. 23 is a cross-sectional view of a variable valve lift apparatus according to the first exemplary variation of the third exemplary embodiment of the present invention.

A variable valve lift apparatus according to the first exemplary variation of the third exemplary embodiment of the present invention is the same as the variable valve lift apparatus according to the third exemplary embodiment of the present invention except for a latching portion, and the same constituent elements will be designated by the same reference numbers and will be described by the same reference numbers as in other drawings.

Referring to FIG. 21 and FIG. 23, a variable valve lift apparatus according to the first exemplary variation of the third exemplary embodiment of the present invention includes an inner rocker arm body 510 of which a first contact portion 512 is formed thereto, of which a guide hole 514 is formed there inside, of which a valve 530 is disposed to an end thereof, and the inner rocker arm body 510 pivoting around a rotation shaft 550, an outer rocker arm body 520 of which a second contact portion 522, further protruded than the first contact portion 512, is formed thereto, of which a lift protrusion 524 is formed thereto, and the outer rocker arm body 520 rotating around the rotation shaft 550, a latching portion 560*a* which is disposed within the guide hole 514 and selectively protruded to connect to the lift protrusion 524, a latching portion support pin 566*a* which guides the latching portion 560*a* and is connected to the inner rocker arm body 510, and a lost motion spring 580 elastically supporting the outer rocker arm body 520.

The latching portion 560*a* includes a hollow latching pin 562*a* of which a moving slot 564*a* is formed thereto along a longitudinal direction of the hollow latching pin 562*a* for the latching portion support pin 566*a* to be inserted thereinto, and a latching pin spring 568*a* which is disposed within the hollow latching pin 562*a* to elastically support the hollow latching pin 562*a*.

The latching portion 560*a* further includes a spring guide portion 567 connected to the latching portion support pin 566*a* and slidably disposed within the hollow latching pin 562*a*.

The spring guide portion 567 includes a spring insert protrusion 567*a* protruded from the spring guide portion 567 for the latching pin spring 566*a* to be connected thereto.

Figure 24:
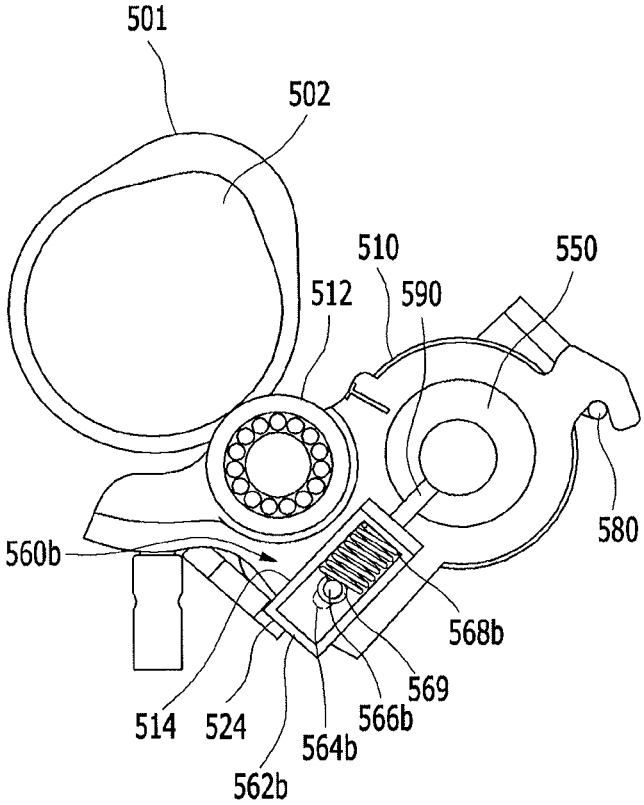
FIG. 24 is a cross-sectional view of a variable valve lift apparatus according to the second exemplary variation of the various exemplary embodiments of the present invention.

FIG. 24 is a cross-sectional view of a variable valve lift apparatus according to the second exemplary variation of the third exemplary embodiment of the present invention.

A variable valve lift apparatus according to the second exemplary variation of the third exemplary embodiment of the present invention is the same as the variable valve lift apparatus according to the third exemplary embodiment of the present invention except for a latching portion, and the same constituent elements will be designated by the same reference numbers and will be described by the same reference numbers as in other drawings.

Referring to FIG. 21 and FIG. 24, a variable valve lift apparatus according to the second exemplary variation of the third exemplary embodiment of the present invention includes an inner rocker arm body 510 of which a first contact portion 512 is formed thereto, of which a guide hole 514 is formed there inside, of which a valve 530 is disposed to an end thereof, and the inner rocker arm body 510 pivoting around a rotation shaft 550, an outer rocker arm body 520 of which a second contact portion 522, further protruded than the first contact portion 512, is formed thereto, of which a lift protrusion 524 is formed thereto, and the outer rocker arm body 520 rotating around the rotation shaft 550, a latching portion 560*b* which is disposed within the guide hole 514 and selectively protruded to connect to the lift protrusion 524, a latching portion support pin 566*b* which guides the latching portion 560*b* and is connected to the inner rocker arm body 510, and a lost motion spring 580 elastically supporting the outer rocker arm body 520.

The latching portion 560*b* includes a hollow latching pin 562*b* of which a moving slot 564*b* is formed thereto along a longitudinal direction of the hollow latching pin 562*b* for the latching portion support pin 566*b* to be inserted thereinto, and a latching pin spring 568*b* which is disposed within the hollow latching pin 562*b* to elastically support the hollow latching pin 562*b*.

A link 569, shaped as a ring, is formed to an end of the latching pin spring 568*b* and is strongly connected to the latching portion support pin 566*b*.

A contacting surface, as shown in FIG. 14, may be formed to the latching portion support pin 566*b* for the latching pin spring 568*b* to closely contact thereto.

And also, a connecting hole may be formed to the latching portion support pin 566*b* for and end of the latching pin spring 568*b* to be inserted thereinto, or a connecting protrusion may be formed to the latching portion support pin 566*b* for and end of the latching pin spring 568*b* to be connected thereto, as shown in FIG. 15 and FIG. 16.

According to the second exemplary embodiment of the present invention and the exemplary variations, since the latching portion support pins 566, 566*a*, 566*b* are fixed and the hollow latching pins 562, 562*a*, 562*b* are moved being guided by the moving holes 564, 564*a*, 564*b* respectively, and thus movement of the hollow latching pins 562, 562*a*, 562*b* are stable.

And thus, the hollow latching pin springs 568, 568*a*, 568*b* may be stably compressed or extended so as to reduce abrasion and increase durability.

The spring guide portion 567 may be act as a stopper when the latching pin spring 568*a* is excessively compressed to impact.

Since both ends of the latching pin springs 568, 568*a*, 568*b* are supported in parallel and thus the latching pin springs 568, 568*a*, 568*b* are structurally stable.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

an outer tappet body of which a latching portion connecting hole and an outer tappet body guide hole are formed therewithin;

an inner tappet body of which an inner tappet body guide hole is formed therewithin and slidably disposed within the outer tappet body;

a latching portion which is disposed within the inner tappet body guide hole and selectively coupled to the latching portion connecting hole;

a latching portion support pin which guides the latching portion along a longitudinal direction of the inner tappet body guide hole and is connected to the inner tappet body;

a hydraulic pressure chamber which is formed in the outer tappet body and selectively receives hydraulic pressure;

a plunger which is slidably disposed in the outer tappet body guide hole and selectively inserts the latching portion into the latching portion connecting hole according to the hydraulic pressure supplied from the hydraulic pressure chamber; and a valve connected to the inner tappet body, wherein the latching portion includes:

a hollow latching pin of which a moving slot is formed thereto along a longitudinal direction of the hollow latching pin for the latching portion support pin to be inserted thereinto;

a latching pin spring which is disposed in the hollow latching pin and engaged with the latching portion support pin to elastically support the hollow latching pin toward the plunger; and a spring guide portion substantially corresponding to a shape of an inner circumference of the hollow latching pin, slidably disposed within the hollow latching pin, and fixedly connected to the latching portion support pin that traverses the hollow latching pin and has one end engaged with the moving slot on one side of the hollow latching pin and another end engaged with the moving slot on an opposite side of the hollow latching pin.

2. The variable valve lift apparatus of claim 1, wherein the spring guide portion includes a spring insert protrusion protruded from a surface of the spring guide portion for the latching pin spring to be connected thereto.

3. A variable valve lift apparatus comprising:

an inner swing arm body of which a first contact portion is formed thereto, of which a guide hole is formed there inside, of which a valve is disposed to an end thereof, and of which the other end thereof is supported by a hydraulic lash adjuster, wherein the inner swing arm selectively pivots around a rotation shaft;

an outer swing arm body of which a second contact portion is formed thereto and further protrudes than the first contact portion, wherein a lift protrusion is formed to the outer swing arm body and wherein the outer swing arm body selectively rotates around the rotation shaft pivotally coupled to the end of the inner swing arm body;

a latching portion which is disposed within the guide hole and selectively protruded to connect to the lift protrusion;

a latching portion support pin which guides the latching portion along a longitudinal direction of the guide hole and is connected to the inner swing arm body; and a lost motion spring elastically supporting the outer swing arm body, wherein the latching portion includes:

a hollow latching pin of which a moving slot is formed thereto along a longitudinal direction of the hollow latching pin for the latching portion support pin to be slidably inserted thereinto;

a latching pin spring which is disposed in the hollow latching pin and engaged with the latching portion support pin to elastically support the hollow latching pin; and a spring guide portion substantially corresponding to a shape of an inner circumference of the hollow latching pin, slidably disposed within the hollow latching pin, and fixedly connected to the latching portion support pin that traverses the hollow latching pin and has one end engaged with the moving slot on one side of the hollow latching pin and another end engaged with the moving slot on an opposite side of the hollow latching pin.

4. The variable valve lift apparatus of claim 3, wherein the spring guide portion includes a spring insert protrusion protruded from a surface of the spring guide portion for the latching pin spring to be connected thereto.

5. A variable valve lift apparatus comprises:

an inner rocker arm body of which a first contact portion is formed thereto, of which a guide hole is formed there inside, of which a valve is disposed to an end thereof, and the inner rocker arm body selectively pivoting around a rotation shaft;

an outer rocker arm body of which a second contact portion is formed thereto and further protrudes than the first contact portion, wherein a lift protrusion is formed to the outer rocker arm body and wherein the outer rocker arm body selectively rotates around the rotation shaft pivotally coupled to the end of the inner rocker arm body;

a latching portion which is disposed within the guide hole and selectively protruded to connect to the lift protrusion;

a latching portion support pin which guides the latching portion and is connected to the inner swing arm body; and a lost motion spring elastically supporting the outer rocker arm body, wherein the latching portion includes:

a hollow latching pin of which a moving slot is formed thereto along a longitudinal direction of the hollow latching pin for the latching portion support pin to be slidably inserted thereinto;

a latching pin spring which is disposed within the hollow latching pin and engaged with the latch portion support pin to elastically support the hollow latching pin; and a spring guide portion substantially corresponding to a shape of an inner circumference of the hollow latching pin, slidably disposed within the hollow latching pin, and fixedly connected to the latching portion support pin that traverses the hollow latching pin and has one end engaged with the moving slot on one side of the hollow latching pin and another end engaged with the moving slot on an opposite side of the hollow latching pin.

6. The variable valve lift apparatus of claim 5, wherein the spring guide portion includes a spring insert protrusion protruded from a surface of the spring guide portion for the latching pin spring to be connected thereto.

* * * * *